United States Patent [19]

Freeman

[11] 4,389,035

[45] Jun. 21, 1983

[54] HANGER-TYPE CEILING-ATTACHABLE SUPPORT HAVING SELF-DISPENSING CEMENT

[76] Inventor: James D. Freeman, 11 W. Grand Ct., Springfield, Ill. 62704

[21] Appl. No.: 204,646

[22] Filed: Nov. 6, 1980

[51] Int. Cl.[3] ..... F16M 13/00

[52] U.S. Cl. ..... 248/542; 248/205 A; 248/467

[58] Field of Search ..... 248/542, 205 A, 467, 248/206 R, 544, 318; 52/105; 294/19 R

[56] References Cited

U.S. PATENT DOCUMENTS

| | | | |
|---|---|---|---|
| 1,971,396 | 8/1934 | DeWaide | 248/467 X |
| 2,190,550 | 2/1940 | Simmons | 248/205 A X |
| 2,451,194 | 10/1948 | Braun | 248/205 A X |
| 3,516,165 | 1/1969 | Pfeffer | 248/544 X |
| 3,532,316 | 10/1970 | Mathes | 248/467 X |
| 3,866,873 | 2/1975 | Bohli | 248/205 A |
| 4,079,978 | 3/1978 | McMullin | 294/19 R |
| 4,220,310 | 9/1980 | Jantzen | 294/19 R |

FOREIGN PATENT DOCUMENTS

| | | | |
|---|---|---|---|
| 823963 | 1/1938 | France | 248/467 |
| 1461581 | 11/1966 | France | 248/205 A |
| 144903 | 4/1954 | Sweden | 248/206 R |

*Primary Examiner*—William E. Lyddane
*Assistant Examiner*—Sarah A. Lechok
*Attorney, Agent, or Firm*—Ralph F. Staubly

[57] ABSTRACT

A hanger-type ceiling-attachable support has a shallow pan engageable against a ceiling surface. A bellows or a piston-in-cylinder type of reservoir for liquid cement underlies the pan, and when it is compressed upwardly by a post depending from the reservoir, injects cement into the pan and against the ceiling surface. The depending post serves both (1) as an attachment device for a plural-section manipulating pole and (2) as a fastener for a suspension wire. The pole sections are inter-nestable for storing and carrying. A horizontally adjustable measuring rod aids in accurately spacing being-installed supports from previously installed ones.

10 Claims, 9 Drawing Figures

HANGER-TYPE CEILING-ATTACHABLE SUPPORT HAVING SELF-DISPENSING CEMENT

BACKGROUND AND OBJECTS OF THE INVENTION

It is known to provide fastening devices with shallow face-depressions for receiving cement injected into said depressions and against a supporting surface, e.g. U.S. Pat. No. 3,532,316 to Mathes. It is also known to provide a fastening device with self-contained liquid adhesives, e.g. U.S. Pat. No. 3,866,873 to Bohli. But it is not known to provide a hanger-type ceiling fastener having (1) a built-in piston or bellows-type injector, (2) a plural-section manipulating pole, and (3) a transaxially-adjustable measuring rod for gauging the distances between serially installed supports. It is the principal object of this invention to supply such a support. Other objects and advantages will appear hereinafter.

BRIEF DESCRIPTIONS OF THE DRAWING FIGURES

DETAILED DESCRIPTION

Figure 1:
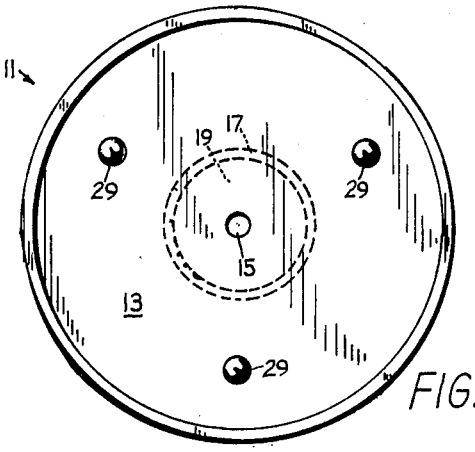
FIG. 1 is a plan view of a preferred embodiment of the invention.
Figures 5, 6:
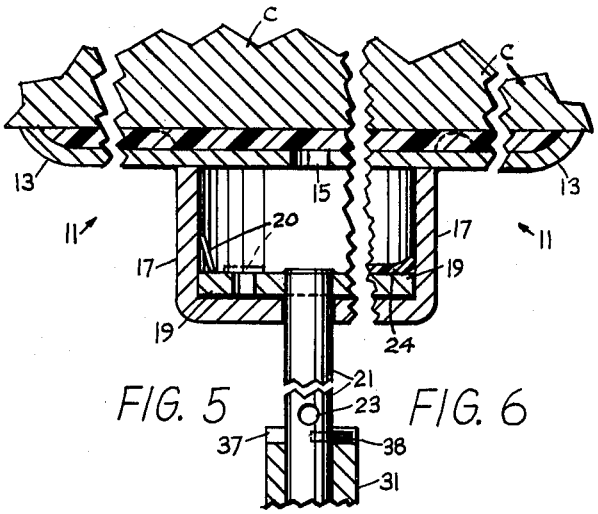
FIG. 5 is an enlarged fragmentary view like FIG. 4 but showing the left two-thirds of a species having a vacuum-relieving displaceable disk.
FIG. 6 is an enlarged fragmentary view like FIGS. 4 and 5 but showing the right one-third of a species having a vacuum-relieving flexible piston-ring.
Figure 2:
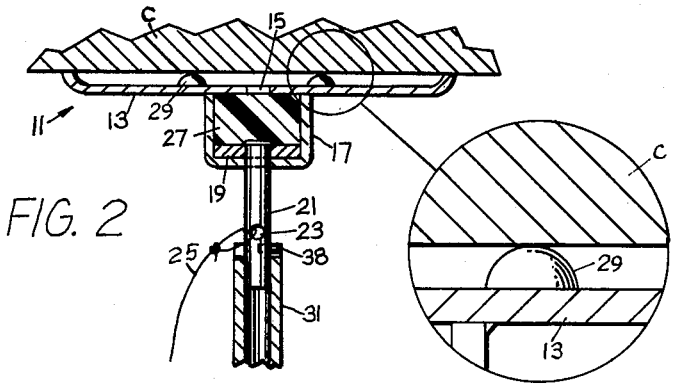
FIG. 2 is an elevational view of the disclosure of FIG. 1 (in section on line 2—2 of FIG. 1) showing the support unit positioned for, but prior to, the attachment operation.
Figure 3:
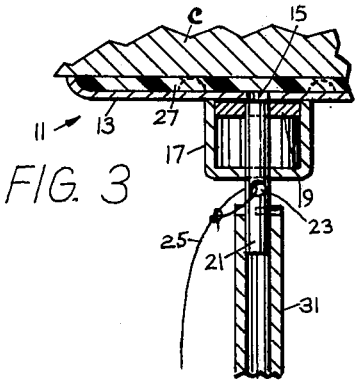
FIG. 3 is a view like FIG. 2 but showing completion of the cement-injecting step.

With reference first to FIGS. 1-6 of the drawings, the numberal 11 generally designates a preferred (first species) embodiment of the invention. The support unit 11 comprises basically a slightly dished disk or plate 13 medially apertured at 15, a cup 17 underlying and sealed to the medial portion of said plate 13 and defining a cylinder, a piston 19 reciprocatable in said cylinder by a rod 21 which is transversely bored at 23 to receive a hanger wire 25, and a volume of initially liquid quick-setting cement 27 in the cylinder chamber.

With the unit 11 pressed against the surface of the ceiling C an upward push on the rod 21 forces cement 27 through the aperture 15 into and through the dished area of the plate 13. The aperture 15 can be initially sealed by a thin easily displaced or rupturable membrane (not shown). Optionally, the plate 13 can have upwardly convex protuberances 29 die-pressed therein to prevent any upward bending of its central area by the force exerted by the pressurized cement.

Figure 7:
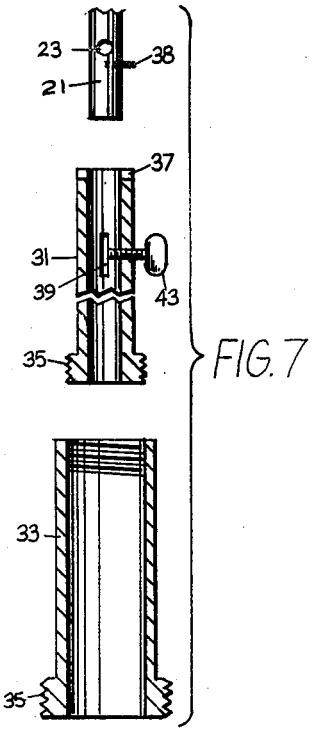
FIG. 7 is an exploded elevational view of a plural-section pole for positioning and manipulating the support unit.
Figure 4:
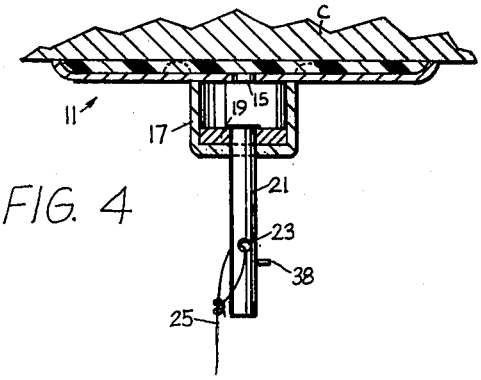
FIG. 4 is a view like those of FIGS. 2 and 3 but showing parts of the ceiling-attached support in their final relative positions.

The lower end of the rod 21 is of a diameter for snug fitting into the upper end of a hollow pole section 31. One (or more) additional pole section(s) 33 (FIG. 7) of increased diameter can be employed. By adding threaded rings 35 to the lower ends of each section the smaller sections can be connected to extend the upward reach of the section below it. Also by inverting each smaller section it can be nested substantially completely within the next-larger section and threadedly retained therein. The upper end of the upper pole section 31 is notched at 37 to receive a pin 38 in the rod 21 for rotating the support to distribute the cement better.

Figure 8:
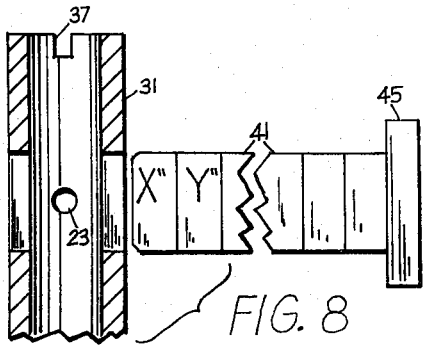
FIG. 8 is an enlarged fragmentary view of FIG. 7 viewed from the right side of the thumb-screw-portion of FIG. 7 after thumb-screw-removal.

The uppermost pole section 31 is provided with an axially elongated through-slot 39 (FIGS. 7 and 8) to receive therethrough a measuring stick 41 (FIG. 8) calibrated in fractions ("X"-"Y") of inches. The stick 41 is clamped by a wing-screw 43 to set the distance that the axis of a being-installed support unit is to be located from an already-placed unit against which the head 45 of the measuring stick 41 is abutted.

Figure 9:
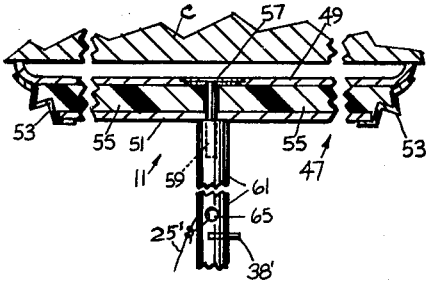
FIG. 9 is a view similar to FIGS. 4-6 but showing a bellows-like cement-dispensing chamber.

FIG. 9 discloses a second species of the invention in which a bellows-type cement-dispensing chamber generally designated 47 is substituted for the cylinder-and-piston unit 17 and 19 of FIGS. 1-6. Chamber 47 is formed by a dished centrally apertured upper plate 49, a lower disk 51 and a vertically undulated flexible band 53 forming a peripherally-sealed chamber for the cement 55. The aperture in the plate 49 is closed by a small disk 57 resting on a countersunk seat surrounding the plate aperture and liftable by a small rod 59 axially connected to the upper end of a larger rod 61. The larger rod 61 is fixed axially to the plate 49 and serves (1) as the cement-extruding operator of the chamber 47, (2) as the means for attachment of the unit to the pole of FIG. 7, and (3) as attachment means (hole) 65 for a hanger wire 251.

The invention having been described, what is claimed is:

1. A ceiling-attachable hanger-type support comprising: a horizontally disposable rigid circular plate-like element having at least one aperture located medially thereof, a cup-like member underlying the medial portion of said plate-like element and defining therewith a marginally sealed chamber, a short rigid post-like hanger-part depending axially from said cup-like member, and an initially liquid quickly-setting cement in said chamber, said chamber being so volume-variably constructed that an upward force exerted against said hanger-part will cause said cement to flow through said aperture and between said plate-like element and a ceiling surface juxtaposed thereto, and said cement being sufficiently viscous initially to hold said support in desired position while said cement hardens.

2. A support according to claim 1 and additionally comprising means on said plate-like element for spacing it slightly from said ceiling surface.

3. A support according to claim 2 wherein said spacing means is an upturned rim on said plate-like element.

4. A support according to claim 2 wherein said spacing means is a plurality of widely spaced protuberances on said plate-like element.

5. A support according to claim 1 and additionally comprising a manipulating pole therefor having means on its upper end for quickly and easily detachably engaging said post-like hanger-part to mount said support thereon.

6. A combination according to claim 5 wherein said pole comprises at least two easily detachably interconnected sections constructed for non-use nested storage.

7. A combination according to claim 6 and additionally comprising a measuring rod horizontally adjustably connectable to said pole for gauging distances between attached and being-attached supports.

8. A support according to claim 1 wherein said cup-like member comprises a cylinder and a piston therein and said piston includes air-admitting check-valve-like means for allowing said piston to return quickly to its initial position after dispensing said cement.

9. A support according to claim 1 wherein said cup-like member comprises a disk underlying said plate-like element and a flexible sleeve-like means peripherally sealing the cement-storing chamber between said disk and said plate-like element.

10. A support according to claim 9 wherein said aperture in said plate-like element is initially sealed by a small disk seated on a countersunk seat around said aperture and is connected to said depending post-like hanger-part by a slender co-axial rod.

* * * * *